US006437746B1

(12) United States Patent
Van Hoozen

(10) Patent No.: US 6,437,746 B1
(45) Date of Patent: Aug. 20, 2002

(54) CELLULAR TELEPHONE ANTENNA ARRAY

(76) Inventor: Allen L. Van Hoozen, 525 N. Quentin Rd. Apartment 311, Palatine, IL (US) 90067

( * ) Notice: Subject to any disclaimer, the term of this patent is extended or adjusted under 35 U.S.C. 154(b) by 0 days.

(21) Appl. No.: 09/712,776

(22) Filed: Nov. 14, 2000

(51) Int. Cl.[7] ..... H01Q 1/24; H01Q 1/52
(52) U.S. Cl. ..... 343/702; 343/841; 343/901
(58) Field of Search ..... 343/702, 900, 343/901, 841; H01Q 1/24, 1/52

(56) References Cited

U.S. PATENT DOCUMENTS

| | | | | | |
|---|---|---|---|---|---|
| 3,579,241 | A | | 5/1971 | Antista et al. | 343/702 |
| 4,201,990 | A | | 5/1980 | Altmayer | 343/747 |
| 5,138,651 | A | * | 8/1992 | Sudo | 343/702 |
| 5,218,370 | A | | 6/1993 | Blaese | 343/702 |
| 5,335,366 | A | * | 8/1994 | Daniels | 343/702 |
| 5,336,896 | A | | 8/1994 | Katz | 250/515.1 |
| 5,392,054 | A | * | 2/1995 | Bottomley et al. | 343/702 |
| 5,513,383 | A | | 4/1996 | Tsao | 455/89 |
| 5,539,419 | A | | 7/1996 | Ogawa et al. | 343/761 |
| 5,541,609 | A | | 7/1996 | Stutzman et al. | 343/702 |
| D382,566 | S | | 8/1997 | Schrum et al. | D14/230 |
| 5,694,137 | A | * | 12/1997 | Wood | 343/702 |
| 5,826,201 | A | * | 10/1998 | Gratias | 343/702 |
| 5,969,685 | A | | 10/1999 | Hayes et al. | 343/702 |

FOREIGN PATENT DOCUMENTS

| | | |
|---|---|---|
| CN | 9900009 | 7/1999 |
| DE | 4221121 | 10/1993 |
| EP | 0652645 | 5/1995 |
| EP | 0959525 | 11/1999 |
| IT | 931146435 | 3/1994 |
| WO | WO 94/14208 | 6/1994 |
| WO | WO 99/56342 | 11/1999 |

* cited by examiner

*Primary Examiner*—Hoanganh Le
(74) *Attorney, Agent, or Firm*—Stetina Brunda Garred & Brucker

(57) ABSTRACT

An antenna assembly which is safer for a user of an electronic communications device, such as a cellular telephone, is disclosed. The electronic communications device includes a housing and a communications port. The antenna assembly includes a stationary active member (e.g., an antenna) that is connected to the communications port. The stationary active member may be an existing antenna on the electronic communications device. The antenna assembly also includes a field diverter which is connected to the stationary active member and reduces radiation adjacent to the electronic communications device. The field diverter is made up of a non-stationary active member and a connecting arm which connects the non-stationary active-member to the stationary active member. Power is divided between the stationary active member and the non-stationary active member in order to decrease radiation in an area where a user's head is located by creating a notch in the azimuth pattern near the area where the user's head is located. The notch forms a sector where the radiation is decreased or diverted to an area away from the sector (i.e., away from the user's head).

21 Claims, 3 Drawing Sheets

CELLULAR TELEPHONE ANTENNA ARRAY

CROSS REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to an antenna assembly, and more particularly to a design for an antenna assembly for a cellular telephone that is safe for the user.

Recent newspaper, radio and television stories are publicizing the possibility of dangers from the current cellular telephone antenna designs. The current antenna designs are variations of a half-wavelength dipole or a quarter-wavelength monopole on a ground plane with the use of inductive coils and/or capacitive top loading to reduce the length of the antenna and to achieve a satisfactory impedance match. These designs all radiate omni-directional in the azimuth plane, which means that the user's head, and hence brain, is irradiated with an amount of electromagnetic (EM) radiation equal to that in any other direction in azimuth which may be unsafe, particularly with repeated exposure.

Published studies have shown that the curvatures of the skull bones and brain matter focuses to some extent on impinging EM radiation creating "hot spots" within the brain. Recently, the media has been focusing on the possible increased risk to the user of developing a brain tumor. However, other medical problems are also possible, including increased risk of stroke, Parkinson's disease and Alzheimer's Syndrome.

Thus, a need exists for a cellular telephone antenna design which decreases the radiation near a user's head and is therefore safer for the user.

BRIEF SUMMARY OF THE INVENTION

In accordance with aspects of the invention, an antenna assembly which is safer for a user of an electronic communications device, such as a cellular telephone, is disclosed. The electronic communications device includes a housing and a communications port. The invention includes a first active member (e.g., an antenna) that is in communication with the communications port. The invention also includes a field diverter which is connected to the first active member and reduces radiation adjacent to the electronic communications device.

In accordance with other aspects of the invention, the field diverter is made up of a second active member opposite (e.g., substantially parallel to) the first active member. Preferably, the pair of active members (i.e., the first active member and the second active member) are substantially identical to each other, for example, both are monopole antennas or both are dipole antennas. In various embodiments, the pair of active members are extendible. In other embodiments, the pair of active member are extracted from the housing. There is about a 90-degree phase differential between the two active members.

In accordance with still other aspects of the invention, the pair of active members are connected by an active connecting member (e.g., an arm). Preferably, the active connecting member is rotatable such that the second active member rotates about the first active member. In various embodiments the active connecting member is extendible. The active connecting member includes a power divider which splits power from the communications port substantially equally between the pair of active members such that the pair of active members have input voltages equal in amplitude.

In accordance with further aspects of the invention, there is also an inactive connecting member opposite (e.g., substantially parallel to) the active connecting member. Preferably, the inactive connecting member is made of non-metallic and/or dielectric materials.

In accordance with still further aspects of the invention, there is a transmit enable switch that is only operable when the second active member is in a transmit detented position. There may also be a transmit disable switch that disables transmissions from the electronic communications device when the pair of active members are not properly spaced from each other. The functionality of the transmit enable switch and transmit disable switch can be combined into a single switch. Preferably, the electronic communications device is always capable of receiving an incoming signal (e.g., an incoming call).

In accordance with yet further aspects of the invention, the antenna assembly is constructed to decrease radiation in an area where a user's head is located, wherein an azimuth pattern for the antenna assembly includes a notch in the azimuth pattern near the area where the user's head is located. The notch forms a sector of about 55 degrees in which the radiation is decreased (e.g. the radiation in the sector is decreased by at least 20 dB). The radiation is increased (by about 3 dB) in an area away from the user's head.

BRIEF DESCRIPTION OF THE DRAWINGS

These, as well as other features of the present invention, will become more apparent upon reference to the drawings wherein.

DETAILED DESCRIPTION OF THE INVENTION

The present invention is directed to an antenna system (e.g., for a cellular telephone) that reduces EM radiation directed towards the head and brain of a user by 20 dB or more. In exemplary embodiments, the antenna of the present invention is compatible with each cellular telephone manufacturer's currently designed telephones, for example, a cellular telephone with a dipole antenna.

Figure 1:
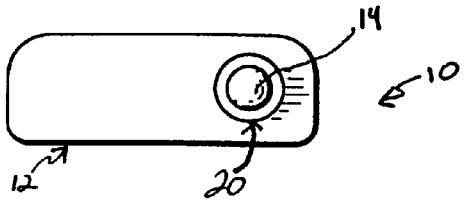
Fig. 1 (PRIOR ART)
FIG. 1 is a top view of a prior art cellular telephone.
Figure 2:
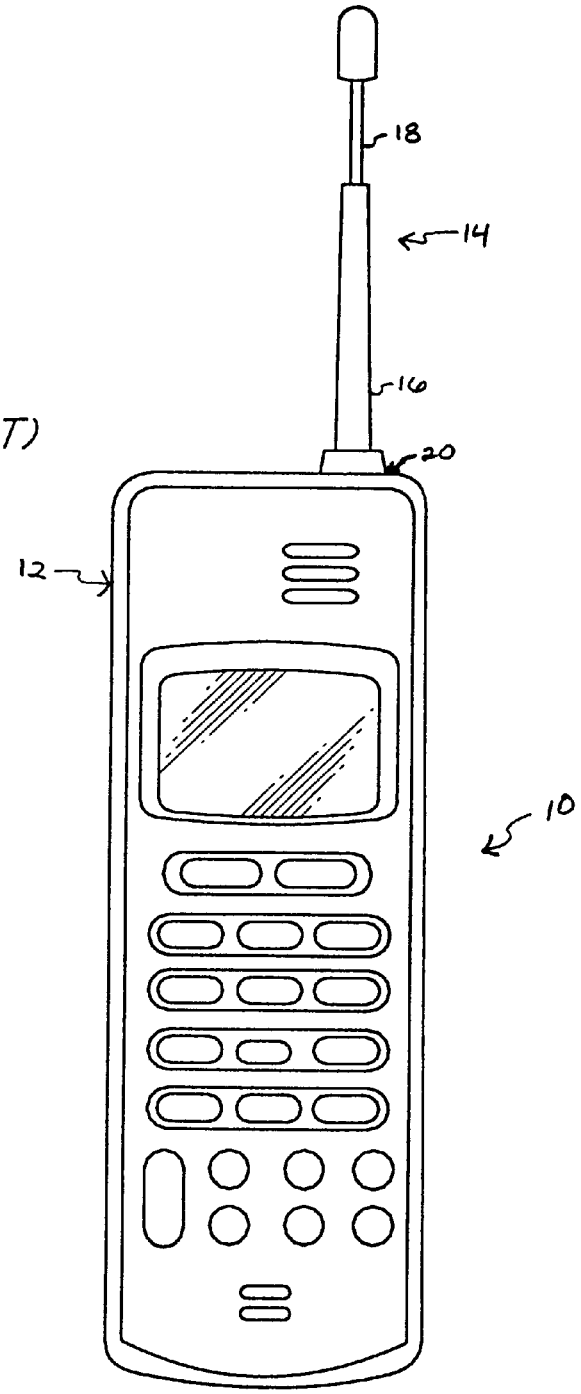
Fig. 2 (PRIOR ART)
FIG. 2 is a front view of the cellular telephone of FIG. 1.

FIGS. 1 and 2 illustrate exemplary front and side views, respectively, of a typical (prior art) cellular telephone 10. Telephone 10 includes circuitry (not shown) contained in a housing 12. Exemplary (prior art) telephone 10 includes a stationary active member (e.g., an antenna) 14 which is proximate the housing 12, for example, proximate the top of the housing in the illustrated example. It will be appreciated that in various embodiments the stationary active member 14 may be a telescoping structure wherein the antenna may be located within the housing 12 when the user is not transmitting, but can be placed in the extended position when the user wishes to transmit. In the example shown in FIG. 2, stationary active member 14 includes a fixed portion 16 and an extendible portion 18.

The stationary active member 14 is stationary (not necessarily static) in that its position relative to the telephone 10 (e.g., connected to a communications port 20) is constant even though the stationary active member itself may be not be static (e.g., may be telescoping or may pivot). For example, the stationary antenna 14 of FIG. 1 is located on the right-hand side of the top of the telephone 10 and is connected to communications port 20. Communications port 20 forwards input signals received by the stationary active member 14 to the circuitry. Similarly, output (or transmit) signals are sent from the circuitry to the stationary active member 14 via the communications port 20. The exemplary embodiment illustrated and described herein is described with respect to the details and dimensions for a telephone with a half-wavelength dipole antenna 14. As discussed above, it will be appreciated that embodiments exist for virtually every cellular telephone model manufactured by any manufacturer. For example, the antenna could be a quarter wavelength monopole antenna with a ground plane within the case, a quarter wavelength monopole with a ground plane within the case and the length of the monopole shortened by using an inductive coil at the feed point at the base of the monopole and/or a captive load at the tip of the monopole.

Figure 4:
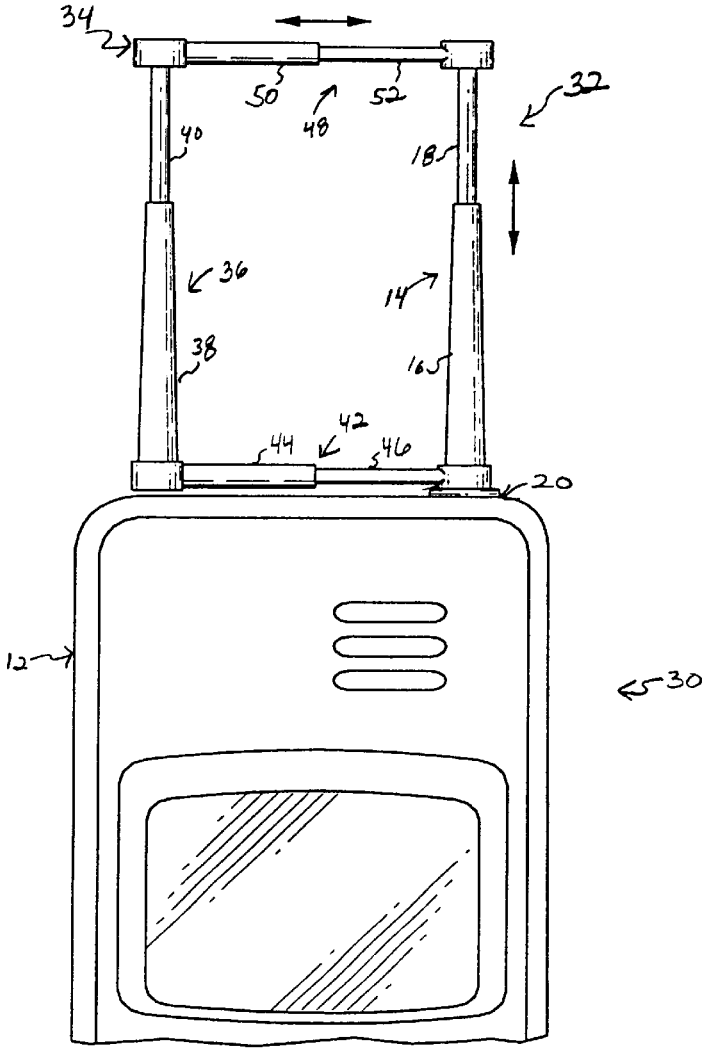
FIG. 4 is a front view of the cellular telephone of FIG. 3.
Figure 5:
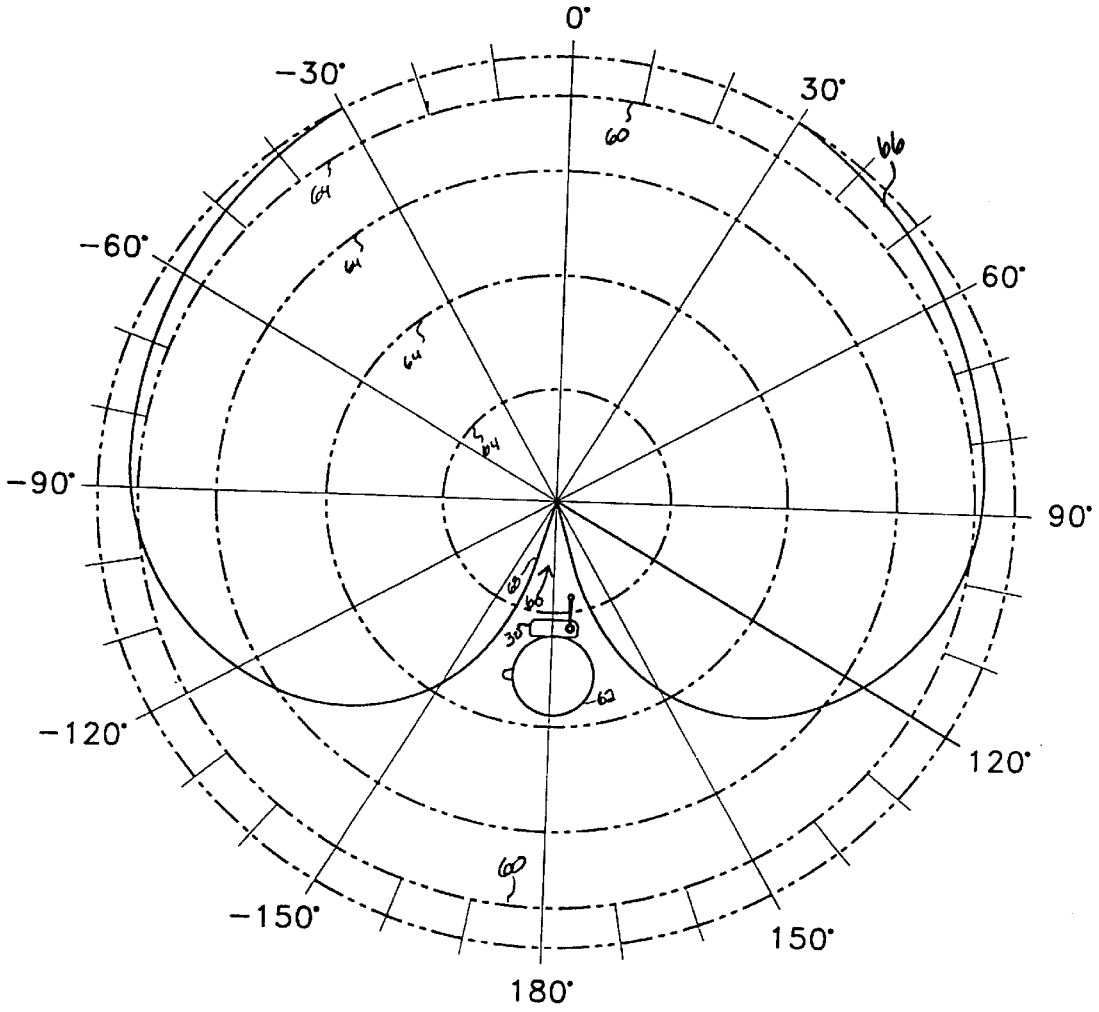
FIG. 5 is an illustration showing the azimuth patterns for a single dipole and for the antenna system of the present invention with a pictorial of the head and telephone positions.

In accordance with the present invention, a safer cellular telephone 30 (shown in FIGS. 3 and 4) includes a field diverter 32 in addition to the elements of prior art telephone 10. The field diverter 32 diverts radiation away from the user's head as shown in FIG. 5 and described later. The field diverter 32 includes, a non-stationary active member 36 which is preferably identical to the stationary active member 14. For example, the non-stationary active member 36, like the stationary active member 14, is a telescoping antenna which includes a fixed member 38 and an extendible member 40.

Figure 3:
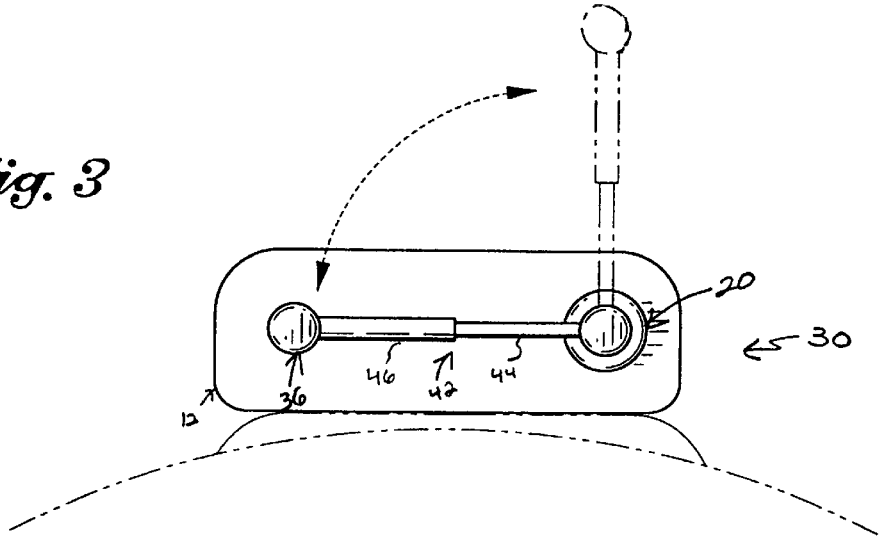
FIG. 3 is a top view of a cellular telephone with an antenna formed in accordance with the present invention.

The non-stationary active member 36 is connected to the stationary active member 14 by a connecting arm 42 which is capable of rotating, e.g., 90 degrees, to a detented position, as shown in FIG. 3. In addition, a 90-degree power divider is used to split the incoming power from the telephone's transmitter circuitry substantially evenly (from 1:1 to 0.95:1.05) between the two active members 14 and 36, but with a 90-degree phase differential (+/−10 degrees) between the signal communicated between the two active members. To ensure proper antenna deployment before the transmitter power is delivered to the active members 14 and 36, the connecting arm 42 activates a transmit enable switch (not shown) which enables the transmit circuitry only when the non-stationary active member 36 is in the transmit detented position. The receiver circuitry is always operational to receive the "ring" of an incoming call.

Preferably, the input voltages of the active members 14 and 36 are equal in amplitude and 90 degrees apart in phase. As described above a power divider divides the voltage evenly between the antennas 14 and 36. The transmit power enters the input port of the power divider and is split evenly within he device such that one-half of the power exits the device via each of the two exit ports. Various implementations can be used to divide the power, for example, a discrete 90 degree hybrid (for example Model 4356A Quadrature hybrid or Broadband 90° Hybrid, both manufactured by Narda, a subsidiary of Loral) may be used, a micro-strip etched power divider with an additional quarter-wavelength at the transmit frequency, e.g., 90 degrees, in line length leading to the detented antenna (for example, a Multi-Octave Type SMA 2-Way Power Divider, manufactured by Narda, a subsidiary of Loral) may be used, or another variation may be used. It may be useful in some cases to modify elements (e.g., the inductance coil at the base) of the currently used impedance matching network as well, in order to better match the input impedance of the antenna pair to the feed network.

Ideally, the pair of active members 14 and 36 are one quarter wavelength apart at the transmit frequency to a tolerance of +/−5% (i.e., 20 to 30% of the transmit frequency wavelength). For some cellular telephone designs, this phase differential may be more than the width of the telephone body, in which case, the connecting "arm" 42 may be telescoping, such as the connecting arm shown in FIG. 4 which includes a fixed member 44 and an extendible member 46.

Various embodiments also include an inactive structure 48 (preferably made of non-metallic and/or dielectric materials) that allows the two active members 14 and 36 to be pushed side-by-side when in the stored condition and pulled out to the appropriate spacing when being readied for use. As with connecting arm 42, the inactive structure may be telescoping, and include a fixed member 50 and an extendible member 52.

Exemplary embodiments may also include a transmit disable switch (not shown) to disable the transmitter function when the active members 14 and 36 are not at the appropriate spacing. Preferably, this switch is combined with the transmit enable switch to disable the transmitter function when the non-stationary active member 36 is not in its detented position. If the switches are combined, a single switch activates the transmitter function only when the two antennas are in their proper positions and spacing. In this case, two motions (performed in either order) are required by the user: (1) the antennas are pulled apart to the appropriate spacing; and (2) the pivoting antenna is rotated to the detented position.

FIG. 5 shows the azimuth patterns for a single dipole 60 and for the antenna system of the present invention with a pictorial of the user's head 62 and telephone 30 positions. Each of the rings 64 represents 10 dB. It will be appreciated that while the following comparisons are directed to a dipole, they hold true for any variation of dipole or monopole formed in accordance with the present invention. The invention has approximately 3 dB more gain 66 in the direction away from the head than the single dipole 60 has, as shown in FIG. 5. As is shown, for the 180 degrees starting from facing forward through the side directly away from the head and ending directly behind, the present invention has gain equal to or greater than a single dipole. The additional gain over this region is due to the "notch" in the pattern 68 in the area where the head 40 (and, therefore, the brain) is located. There is an approximately 55-degree sector 70 created by notch 68 where the radiation is 20 dB or more below that of the single dipole in which the head 62 and brain are located.

In the elevation plan of FIG. 5 (which is 0 degrees), the present invention has the same pattern 66 as the single dipole 60. In each case, there is a null in the pattern where the head 62 is located. Hence, the elevation pattern radiation does not create a hazard to the head 62 and brain, rather the azimuth pattern creates the hazard.

Azimuth vs. relative gain for an exemplary embodiment of the invention (as shown in FIG. 5) is shown in Table I. The configuration used for the example shown in Table I is as follows: frequency is 0.9 GHz; antenna spacing is 8.328 cm; amplitude distribution is uniform; phase shift is 90 degrees; the antenna is a dipole antenna with a length of 16.655 cm; there is no ground plane; the polarization is substantially parallel to the length of the antenna; the absolute maximum gain is 5.16 dBi; and the absolute maximum gain repeated for one antenna is 2.15 dBi; hence a 3 dB difference. Relative gain subtracts the 5.16 dBi from all of the values thereby normalizing the peak gain to 0 dB.

TABLE I

| Azimuth (in degrees) | Relative Gain (in dB) |
|---|---|
| 0 | 0 |
| +/−1 | −5.17726E-07 |
| +/−2 | −3.106357E-06 |
| +/−3 | −9.836804E-06 |
| +/−4 | −2.407432E-05 |
| +/−5 | −5.151464E-05 |
| +/−6 | −9.888678E-05 |
| +/−7 | −1.742183E-04 |
| +/−8 | −2.865708E-04 |
| +/−9 | −4.47856E-04 |
| +/−10 | −6.69989E-04 |
| +/−11 | −9.661841E-04 |
| +/−12 | −1.35277E-03 |
| +/−13 | −1.845826E-03 |
| +/−14 | −2.462744E-03 |
| +/−15 | −3.223781E-03 |
| +/−16 | −4.148189E-03 |
| +/−17 | −5.259137E-03 |
| +/−18 | −6.578546E-03 |
| +/−19 | −8.130985E-03 |
| +/−20 | −9.941095E-03 |
| +/−21 | −1.203671E-02 |
| +/−22 | −1.444395E-02 |
| +/−23 | −1.719194E-02 |
| +/−24 | −2.031017E-02 |
| +/−25 | −2.382991E-02 |
| +/−26 | −2.778157E-02 |
| +/−27 | −3.219762E-02 |
| +/−28 | −3.711262E-02 |
| +/−29 | −4.255965E-02 |
| +/−30 | −4.857394E-02 |

TABLE I-continued

| Azimuth (in degrees) | Relative Gain (in dB) |
|---|---|
| +/−31 | −5.519114E-02 |
| +/−32 | −6.244735E-02 |
| +/−33 | −7.038022E-02 |
| +/−34 | −7.902692E-02 |
| +/−35 | −8.842605E-02 |
| +/−36 | −9.861715E-02 |
| +/−37 | −.1096379 |
| +/−38 | −.1215302 |
| +/−39 | −.1343332 |
| +/−40 | −.1480884 |
| +/−41 | −.1628372 |
| +/−42 | −.1786201 |
| +/−43 | −.1954798 |
| +/−44 | −.2134588 |
| +/−45 | −.2325992 |
| +/−46 | −.252944 |
| +/−47 | −.2745358 |
| +/−48 | −.2974186 |
| +/−49 | −.3216347 |
| +/−50 | −.3472292 |
| +/−51 | −.374245 |
| +/−52 | −.4027253 |
| +/−53 | −.4327153 |
| +/−54 | −.4642577 |
| +/−55 | −.4973982 |
| +/−56 | −.53218 |
| +/−57 | −.5686468 |
| +/−58 | −.6068445 |
| +/−59 | −.6468159 |
| +/−60 | −.6886062 |
| +/−61 | −.7322592 |
| +/−62 | −.7778198 |
| +/−63 | −.8253322 |
| +/−64 | −.8748406 |
| +/−65 | −.9263904 |
| +/−66 | −.9800246 |
| +/−67 | −1.035789 |
| +/−68 | −1.093728 |
| +/−69 | −1.153885 |
| +/−70 | −1.216307 |
| +/−71 | −1.281036 |
| +/−72 | −1.348119 |
| +/−73 | −1.4176 |
| +/−74 | −1.489524 |
| +/−75 | −1.563937 |
| +/−76 | −1.640885 |
| +/−77 | −1.720412 |
| +/−78 | −1.802564 |
| +/−79 | −1.887387 |
| +/−80 | −1.974929 |
| +/−81 | −2.065236 |
| +/−82 | −2.158354 |
| +/−83 | −2.254333 |
| +/−84 | −2.353218 |
| +/−85 | −2.455059 |
| +/−86 | −2.559905 |
| +/−87 | −2.667805 |
| +/−88 | −2.778811 |
| +/−89 | −2.892971 |
| +/−90 | −3.01034 |
| +/−91 | −3.130969 |
| +/−92 | −3.254911 |
| +/−93 | −3.382222 |
| +/−94 | ±3.512957 |
| +/−95 | −3.647171 |
| +/−96 | −3.784926 |
| +/−97 | −3.926277 |
| +/−98 | −4.071289 |
| +/−99 | −4.22002 |
| +/−100 | −4.37254 |
| +/−101 | −4.52891 |
| +/−102 | −4.689198 |
| +/−103 | −4.853477 |
| +/−104 | −5.021817 |
| +/−105 | −5.194294 |
| +/−106 | −5.370983 |
| +/−107 | −5.551965 |

TABLE I-continued

| Azimuth (in degrees) | Relative Gain (in dB) |
|---|---|
| +/−108 | −5.737323 |
| +/−109 | −5.927143 |
| +/−110 | −6.121512 |
| +/−111 | −6.320527 |
| +/−112 | −6.524281 |
| +/−113 | −6.732876 |
| +/−114 | −6.946416 |
| +/−115 | −7.165015 |
| +/−116 | −7.388783 |
| +/−117 | −7.61784 |
| +/−118 | −7.852318 |
| +/−119 | −8.09234 |
| +/−120 | −8.338052 |
| +/−121 | −8.589599 |
| +/−122 | −8.847129 |
| +/−123 | −9.11081 |
| +/−124 | −9.386809 |
| +/−125 | −9.657308 |
| +/−126 | −9.940493 |
| +/−127 | −10.23057 |
| +/−128 | −10.52775 |
| +/−129 | −10.83226 |
| +/−130 | −11.14434 |
| +/−131 | −11.46424 |
| +/−132 | −11.79223 |
| +/−133 | −12.12861 |
| +/−134 | −12.47368 |
| +/−135 | −12.82776 |
| +/−136 | −13.19122 |
| +/−137 | −13.56442 |
| +/−138 | −13.94778 |
| +/−139 | −14.34171 |
| +/−140 | −14.7467 |
| +/−141 | −15.16324 |
| +/−142 | −15.59186 |
| +/−143 | −16.03317 |
| +/−144 | −16.4878 |
| +/−145 | −16.95642 |
| +/−146 | −17.4398 |
| +/−147 | −17.93874 |
| +/−148 | −18.45415 |
| +/−149 | −18.98699 |
| +/−150 | −19.53835 |
| +/−151 | −20.10938 |
| +/−152 | −20.70142 |
| +/−153 | −21.3159 |
| +/−154 | −21.95442 |
| +/−155 | −22.6188 |
| +/−156 | −23.31101 |
| +/−157 | −24.03335 |
| +/−158 | −24.78834 |
| +/−159 | −25.5789 |
| +/−160 | −26.40833 |
| +/−161 | −27.28043 |
| +/−162 | −28.19957 |
| +/−163 | −29.17092 |
| +/−164 | −30.2004 |
| +/−165 | −31.29513 |
| +/−166 | −32.46349 |
| +/−167 | −33.71564 |
| +/−168 | −35.06391 |
| +/−169 | −36.52363 |
| +/−170 | −38.1136 |
| +/−171 | −39.85785 |
| +/−172 | −41.7872 |
| +/−173 | −43.94123 |
| +/−174 | −46.37207 |
| +/−175 | −52.34441 |
| +/−176 | −56.03831 |
| +/−178 | −60 |
| +/−179 | −60 |
| +/−180 | −∞ |

Additional modifications and improvements of the present invention may also be apparent to those of ordinary skill in the art. Thus, the particular parts described and illustrated herein is intended to represent only one embodiment of the present invention, and is not intended to serve as limitations of alternative devices within the spirit and scope of the invention.

What is claimed is:

1. An antenna assembly for an electronic communications device, the electronic communications device having a housing with a communications port, the antenna assembly comprising:

a) a stationary active member that is in communication with the communications port to transmit a stationary active member transmit signal; and b) a non-stationary field diverter that is connected to and solely supported by the stationary active member, wherein the field diverter radiates a phase shifted transmit signal that interacts with the stationary active member transmit signal to create a field isolation zone adjacent to the electronic communications device in which radiation emitted by the stationary active member is reduced, the zone being large enough to fit a user's head;

wherein power is divided from the communications port substantially equally between the stationary active member and the non-stationary field diverter such that the stationary active member and the non-stationary field diverter have input voltages equal in amplitude.

2. The antenna assembly of claim 1, wherein the non-stationary field diverter comprises:

a) a non-stationary active member opposing the stationary active member, wherein the stationary active member and the non-stationary active member form a pair of active members; and b) an active connecting member that connects the non-stationary active member to the stationary active member.

3. The antenna assembly of claim 2, further comprising an inactive connecting member opposing the active connecting member.

4. The antenna assembly of claim 3, wherein the inactive connecting member comprises non-metallic materials.

5. The antenna assembly of claim 3, wherein the inactive connecting member comprises dielectric materials.

6. The antenna assembly of claim 2, wherein the active connecting member is rotatable such that the non-stationary active member rotates about the stationary active member.

7. The antenna assembly of claim 2, wherein the pair of active members are substantially identical to each other.

8. The antenna assembly of claim 7, wherein the pair of active members are monopole antennas.

9. The antenna assembly of claim 7, wherein the pair of active members are dipole antennas.

10. The antenna assembly of claim 2, wherein the pair of active members are extendible.

11. The antenna assembly of claim 2, wherein the pair of active members are extracted from the housing.

12. The antenna assembly of claim 2, wherein the active connecting member is extendible.

13. The antenna assembly of claim 2, wherein the antenna assembly pivots.

14. The antenna assembly of claim 2, wherein there is about a 90-degree phase differential between the stationary active member and the non-stationary active member.

15. The antenna assembly of claim 2, further comprising a transmit enable switch.

16. The antenna assembly of claim 15, wherein the transmit enable switch is only operable when the non-stationary active member is in a transmit detented position.

17. The antenna assembly of claim 2, further comprising a transmit disable switch that disables transmissions from the electronic communications device when the pair of active members are not properly spaced from each other.

18. The antenna assembly of claim 1, wherein the electronic communications device is a cellular telephone.

19. The antenna assembly of claim 1, wherein the electronic communications device is always capable of receiving an incoming signal.

20. An antenna assembly for an electronic communications device, the electronic communications device having a housing with a stationary active member connected to a communications port to transmit a stationary active member transmit signal, the antenna assembly comprising a non-stationary field diverter that is connected to and solely supported by the stationary active member, wherein the field diverter radiates a phase shifted transmit signal that interacts with the stationary active member transmit signal to create a field isolation zone adjacent to the electronic communications device in which radiation emitted by the stationary active member is reduced, the zone being large enough to fit a user's head, and wherein the active connecting member divides power from the communications port substantially equally between the pair of active members such that the stationary active member and the non-stationary active member have input voltages equal in amplitude.

21. The antenna assembly of claim 20, wherein the field diverter comprises:

a) a non-stationary active member opposing the stationary active member; and b) an active connecting member that connects the non-stationary active member to the stationary active member.

* * * * *

UNITED STATES PATENT AND TRADEMARK OFFICE

CERTIFICATE OF CORRECTION

PATENT NO. : 6,437,746 B1
DATED : August 20, 2002
INVENTOR(S) : Allen Van Hoozen It is certified that error appears in the above-identified patent and that said Letters Patent is hereby corrected as shown below:

Title page,
Insert Item:
-- [73] Assignee: Northrop Grumman Corporation, Los Angeles, CA --

Signed and Sealed this

Twentieth Day of May, 2003

JAMES E. ROGAN
*Director of the United States Patent and Trademark Office*